United States Patent [19]

Paliard et al.

[11] Patent Number: 4,976,469

[45] Date of Patent: Dec. 11, 1990

[54] METHOD OF CRUSHING AND COMPACTING ANY MINERAL MATERIAL WHATSOEVER AND SYSTEM FOR CARRYING OUT THIS METHOD

[75] Inventors: Maurice Paliard, Saint Heand; Jean-Marc Martin, Paris; Francis Cochet, Lezinnes; Benoit Valdelievre, Montelimar, all of France

[73] Assignee: CLE, Courbevoie, France

[21] Appl. No.: 382,209

[22] Filed: Jul. 20, 1989

[30] Foreign Application Priority Data

Jul. 22, 1988 [FR] France ..... 8809975

[51] Int. Cl.[5] ..... B02C 25/00

[52] U.S. Cl. ..... 241/24; 241/34; 241/79.1; 241/80

[58] Field of Search ..... 241/34, 24, 29, 152 A, 241/80, 97, 79, 79.1, 30, 19

[56] References Cited

U.S. PATENT DOCUMENTS 3,887,142 6/1975 McElvain .
4,703,897 11/1987 Beisner et al. ..... 241/80 X
4,728,044 3/1988 Duill et al. .

FOREIGN PATENT DOCUMENTS 0220681 5/1987 European Pat. Off. .
3506502 8/1986 Fed. Rep. of Germany .

*Primary Examiner*—Mark Rosenbaum
*Attorney, Agent, or Firm*—Kenyon & Kenyon

[57] ABSTRACT

A system comprising a roll press for crushing and partially agglomerating a mineral material, a conveyor means arranged downstream of this press and associated with a distributor device and allowing to recycle one portion of the crushed and partially agglomerated material to the inlet of the press whereas the other portion of the material issuing from this distributor device feeds a second distributor device one outlet of which communicates with the conveyor means to thereby control the amount and density of the crushed and partially agglomerated material recycled to the feed of the press.

6 Claims, 1 Drawing Sheet

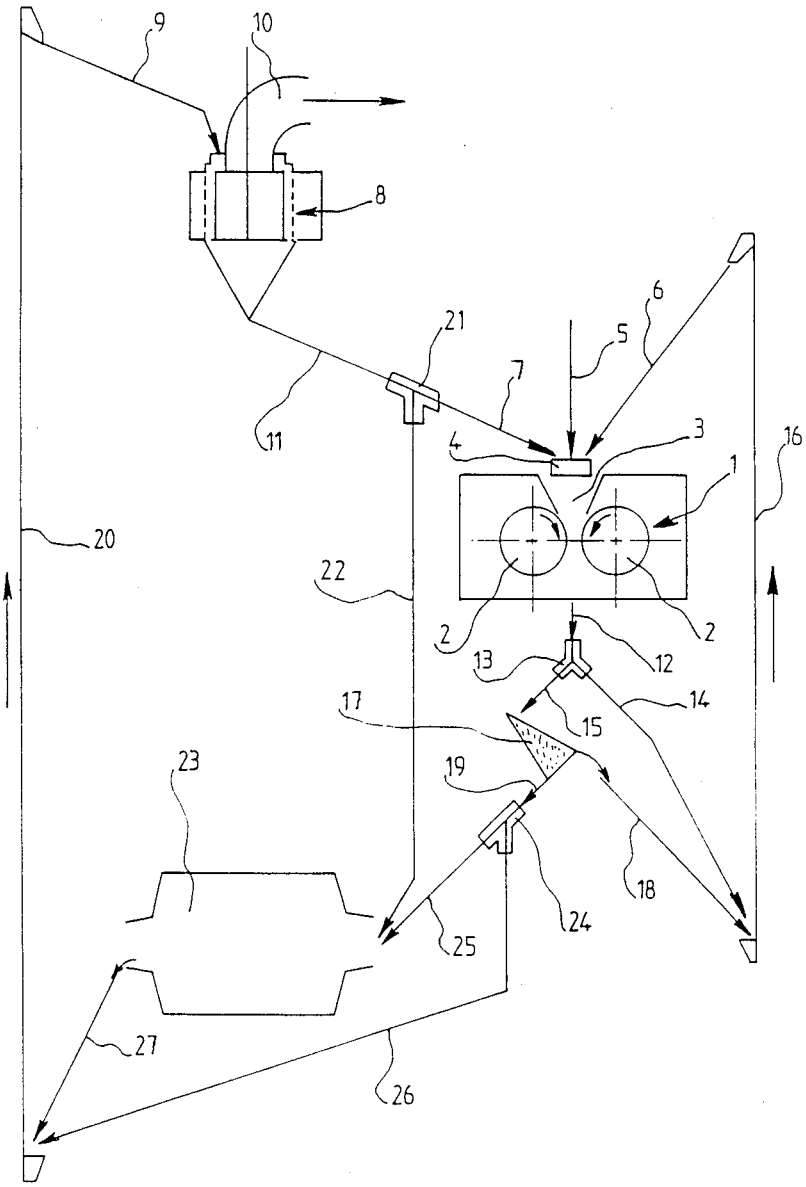
9
10
8
21
6
5
7
11
4
3
16
1
20
22
2
2
13
12
14
17
15
23
19
18
24
25
27
26

METHOD OF CRUSHING AND COMPACTING ANY MINERAL MATERIAL WHATSOEVER AND SYSTEM FOR CARRYING OUT THIS METHOD

The present invention relates essentially to a method of crushing and compacting any mineral material whatsoever such for instance as cement clinker.

It is also directed to a system for carrying out this method.

The use of roll presses for crushing and compacting various mineral or organic materials is known since long ago. It is also known that to obtain a regular operation of roll presses, it is necessary to precondition the material fed to the press to avoid any excessive swelling of the supply.

It is thus known to use for instance on fertilizer or manure compacting presses one or several propelling screws rotated to perform a precompacting of the material being fed to the roll press.

There are also known crushing plants provided with rolls to allow a previous crushing of the material to be crushed thereby enabling to carry out a precompacting of the material before applying the final crushing force.

In all these known systems however it has been found that it was not possible to achieve a stable operation of the roll press which, as is known, has to transmit very high powers to the material in fine crushing applications.

Therefore, the object of the present invention is to remove in particular this inconvenience by providing a method and a crushing system which allow to ideally precondition the material being fed to the press which may thus operate in an optimum manner.

For this purpose, the invention has for its subject matter a method of crushing and compacting any mineral material whatsoever such for instance as cement clinker and of the kind consisting in preconditioning this material before pounding it through crushing in a roll press or the like, characterized in that the preconditioning of the material consists in mixing various forms of the material feeding the press to adjust its density in bulk to a value lying between about 0.60 $D_p$ and 0.90 $D_p$, $D_p$ being the density of the agglomerated or compacted product issuing from the press so as to achieve a stable operation of the latter hence to stabilize the instantaneous power consumption required by the crushing.

This process is further characterized in that the density in bulk of the material supplied to the press lies between 0.68 $D_p$ and 0.85 $D_p$.

According to still another characterizing feature of this method for crushing cement, the density in bulk of the material being supplied to the press is adjusted to range between 1.7 tons/m$^3$ and 2.05 tons/m$^3$.

The invention is also directed to a crushing and compacting system for carrying out the method complying with the above-mentioned characterizing features and of the kind comprising a roll press or the like allowing the crushing and partial agglomeration of any mineral material whatsoever and downstream of this press a conveyor means associated with a distribution device and allowing to recycle one portion of the crushed and partially agglomerated material to the feed of the press.

This system is characterized in that the other portion of the material issuing from said distribution device feeds a second distribution device one outlet of which communicates with the aforesaid conveyor means to thereby adjust or control the amount and the density of the crushed and partially agglomerated material being recycled to the feed of the roll press.

According to still another characterizing feature of the invention, one of the two aforesaid distributor devices is a sieve, a screen or the like.

This system is further characterized in that the roll press is fed with the mineral material from a pneumatic separator or an equivalent device connected to the feed of said press by at least one duct fitted with a third distributor device the outlet of which is connected on the one hand to the inlet of the roll press and, on the other hand, to the other outlet of the aforesaid second distributor device.

According to another characterizing feature of this system, a density measuring apparatus is advantageously arranged at the inlet of the press.

The invention will be better understood and further objects, characterizing features, details and advantages thereof will appear more clearly as the following explanatory description proceeds with reference to the accompanying diagrammatic drawing given by way of non-limiting example only, illustrating a presently preferred specific embodiment and wherein the single FIGURE diagrammatically shows a crushing system according to the principles of this invention.

According to an exemplary embodiment, the system shown on the single FIGURE is a closed-circuit crushing system comprising a press 1 with rolls 2 the inlet 3 of which is provided with an appliance for measuring the density of the products fed to the press 1, which appliance is generally designated at 4.

The press 1 is supplied with raw products as shown by the line 5, with a product crushed and partially agglomerated by the press and recycled as shown by the line 6 and with granular or powdery products as shown by the line 7, the latter products coming from a pneumatic separator or from an equivalent contrivance 8.

The separator 8 receives a mixture or blend of crushed products as will be described in detail hereinafter and this through the line 9 and it separates said mixture into a fine and finished product which is discharged while being in suspension in the gases extracted through the duct 10 and into a granular or powdery product which issues from the separator 8 through the duct 11. It should be pointed out that the separator 8 provides a de-agglomeration function at the material distribution members.

Downstream of the press 1 with rolls 2, the crushed and agglomerated product forms a flow 12 passing into a first distributor device 13 dividing the material into two partial flows designated at 14 and 15, respectively. The flow 14 essentially comprising compacted slabs is recycled to the inlet 3 of the press 1 by a conveyor means 16 connected to the previously mentioned line 6. The other portion or flow 15 of the material issuing from the first distributor device 13 feeds a second distributor device 17 dividing the flow of crushed and partially agglomerated product on the one hand into coarse elements issuing through the line 18 communicating with the conveyor means 16 and, on the other hand, into fine products exiting through the line 19.

Although this has not been shown, the line 19 could lead directly to the conveyor 20 recycling the fine products to the inlet of the pneumatic separator 8 via the previously mentioned line 9.

The pipeline or duct 11 extending from the outlet of the separator 8 is fitted with a third distributor device 21 the outlet of which is connected on the one hand to the line 7 leading to the inlet 3 of the press 1 and, on the other hand, although this has not been shown, to the outlet 19 of the second distributor system 17 via a duct or the like 22 with the purpose of directly recycling the granular product to the feed of the separator 8.

According to the embodiment shown, the system comprises an additional crushing equipment diagrammatically shown at 23 and which may consist of a ball crusher, a bar crusher, a vibrating crusher, an impact crusher or the like.

Moreover, the outlet 19 may be fitted with a distributor shutter or flap 24 for the finished products issuing from the second distributor device 17.

The distributor shutter or flap 24 subdivides the material which reaches the same into two lines, namely one line 25 leading to the crusher 23 and one line 26 leading to the conveyor 20 which also receives the crushed products extracted from the crusher 23 through the line 27.

Moreover, it is seen on the Figure that the duct 22 instead of being directly connected to the outlet 19 of the second distributor device 17 is connected to the inlet of the crusher 23 which may comprise a ventilation arrangement which may be used for extracting at least one part of the crushed product.

The operation of the system is straightforward derivable from the foregoing description but a number of points should be emphasized.

The density in bulk of the blend or mixture of the various forms of the material fed to the inlet 3 of the roll press 1 through the lines 5, 6 and 7 should be modulated so that it lie within a range allowing a stable operation of the press and this essentially by modulating the proportion of slabs recycled into the line 6 by the actuation of the first distributor system 13. Moreover, as is easily understandable, the aforesaid density in bulk should advantageously be also modulated by acting upon the third distributor device 21 to modulate the proportion of the granular products passing in the line 7. At last, the second distributor device 17 also contributes to the control or adjustment of the density in bulk of the products feeding the press 1 since, as is easily understandable, it performs a function with respect to the amount of slabs issuing from the first distributor device 13 and recycled to the inlet 3 of the press 1 via the conveyor means 16.

It should be pointed out that the second distributor device 17 or the first distributor device 13 may consist of a sieve, a screen, a riddle or the like.

To achieve a stable operation of the system and for thereby stabilizing the instantaneous energy consumption required for the crushing-compacting operation, the density in bulk of the material feeding the roll press should according to an essential characterizing feature of his invention have a value ranging between 0.60 $D_p$ and 0.90 $D_p$, $D_p$ being the density of the agglomerated or compacted product moving out the press.

The density of the material feeding out the press should preferably range between 0.68 $D_p$ and 0.85 $D_p$, it being understood that the control or adjustment of the density giving the press an outstanding operating stability may be carried out in any suitable way.

In this respect, the density measuring apparatus 4 located at the inlet 3 of the press 1 would advantageously permit at any time the control of the density of the products feeding said press, this apparatus being possibly capable of acting automatically upon the distributor devices 13 and 21.

It should be understood that the invention is not at all limited to the embodiment described and shown which has been given by way of example only.

Thus, at the inlet 3 of the roll press it is advantageously possible without leaving the scope of the invention to provide a vibrating hopper to further improve the control or adjustment of the density in bulk of the products supplied to the press.

On the contrary, the invention comprises all the technical equivalents of the means described as well as their combinations if the same are carried out according to its gist and within the scope of the appended claims.

What is claimed is:

1. A method of crushing and compacting any mineral material, especially brittle material, for instance cement clinker and of the type consisting in preconditioning this material before pounding it through crushing in a roll press, wherein the improvement consists in that the preconditioning of the material consists in mixing various forms of the material feeding the press to adjust its density in bulk to a value ranging between about 0.60 $D_p$ and 0.90 $D_p$, $D_p$ being the density of the agglomerated or compacted product issuing from the press in order to achieve a stable operation of the latter and therefore to stabilize the instantaneous power consumption required by the crushing operation.

2. A method according to claim 1, wherein the density in bulk of the material feeding the press is ranging between 0.68 $D_p$ and 0.85 $D_p$.

3. A method according to claim 1, wherein the density in bulk of the material being supplied to the press is adjusted to lie between 1.7 tons/$m^3$ and 2.05 tons/$m^3$.

4. A system for crushing and compacting any mineral material such as cement clinker, comprising:

a roll-press for the crushing and partial agglomeration of the said mineral material;

a first distribution device located downstream said roll-press and dividing the material crushed and partially agglomerated by the roll-press into a first partial flow of essentially compacted slabs, and a second partial flow of crushed material;

conveyor means associated with said first distributor for allowing recycling of said first partial flow of compacted slabs of the feed of the roll-press;

a second distributor device dividing the crushed material of said second partial flow issuing from the first distributor into a flow of coarse elements communicating with said conveyor means and a flow of fine crushed products;

a pneumatic separator receiving said flow of fine crushed products and feeding said roll-press with mineral material through at least one duct; and a third distributor device provided on said duct and the outlet of which is connected on the one hand to the roll-press inlet and, on the other hand, to said flow of fine crushed products issuing from the second distributor;

whereby the amount and density in bulk of the mineral material fed to the roll-press is modulated by the actuation of said first, second and third distributor devices for allowing a stable operation of the said roll-press.

5. A system according to claim 4, wherein one of the two aforesaid distributor devices is a sieve or screen.

6. A system according to claim 4, further comprising an apparatus for measuring the density of the material feeding the press and which is located at the inlet of said press.

* * * * *